US006083051A

United States Patent [19]

Chang

[11] Patent Number: 6,083,051

[45] Date of Patent: Jul. 4, 2000

[54] MINIATURE ELECTRICAL CONNECTOR

[75] Inventor: Yao-Hao Chang, Chung-Ho, Taiwan

[73] Assignee: Hon Hai Precision Ind. Co., Ltd., Taipei Hsien, Taiwan

[21] Appl. No.: 09/219,576

[22] Filed: Dec. 22, 1998

[30] Foreign Application Priority Data

Mar. 2, 1999 [TW] Taiwan ..... 87203043

[51] Int. Cl.[7] ..... H01R 33/00

[52] U.S. Cl. ..... 439/660; 439/736

[58] Field of Search ..... 439/660, 722, 439/736, 607

[56] References Cited

U.S. PATENT DOCUMENTS

Re. 35,508 5/1997 Lemke et al. ..... 439/607
5,993,263 11/1999 Sampson ..... 439/660
6,004,160 12/1999 Korsunsky et al. ..... 439/660

*Primary Examiner*—Gary F. Paumen
*Assistant Examiner*—Tho D. Ta

[57] ABSTRACT

A plug connector for use in a cellular phone for connecting to a battery charger comprises a number of contacts and a dielectric housing insert molded with the contacts. The housing has a body with a wall projecting forward therefrom. Each contact has a front end portion extending forward and downward below a protective cap integrally formed at a front end of the wall so that a bare front end edge of the contact is protected from being affected by humidity and foreign particles outside the cellular phone. An electromagnetic protecting and grounding shield is fixedly mounted to the housing and encloses the contact portions of the contacts. The shield has a front retentive tab abutting a front face of the housing and a rear retentive tab abutting a rear face of the housing whereby pull and push forces acting on the housing can be effectively resisted by the shield.

12 Claims, 7 Drawing Sheets

MINIATURE ELECTRICAL CONNECTOR

BACKGROUND OF THE INVENTION

1. Field of the Invention

The present invention relates to a miniature electrical connector, and particularly to a miniature plug electrical connector used in a cellular phone.

2. The Prior Art

A cellular phone is equipped with a 15-position plug connector for enabling the cellular phone to connect with an auxiliary electrical device such as a battery charger.

FIGS. 5 and 6 show a conventional electrical connector 5. FIG. 5 is a cross-sectional view showing a housing 50 insert molded with a blank contact 51, and FIG. 6 is a perspective view of the conventional connector 5.

To produce the connector 5, a metal sheet is stamped to form the blank contact 51 including fifteen contacts 52 connecting with a front carrier 521 via front V-cuts 522 and a rear carrier 526 via rear V-cuts 525. The front carrier 521 is flush with contact portions 523 of the contacts 52. The blank contact 51 is then brought into a mold (not shown) for insert molding the housing 50 thereon. The housing 50 includes a wall 502 horizontally projecting from a front face 501 thereof to fixedly support the contact portions 523 of the contacts 52 thereon. Tail portions 524 of the contacts 52 extend behind and below a bottom face 503 of the housing 50. Thereafter, the front and rear carriers 521, 526 are bent away from the contacts 52 along the V-cuts 522, 525, respectively. The removal of the front and rear carriers 521, 526 causes front and rear end edges (not labeled) of the contacts 52 to be exposed to air. Since these end edges are not covered by protective coating, humidity and foreign particles may lead to erosion thereof. For the rear end edge, the problem is not so serious since it is located inside the cellular phone and is protected by solder soldering the tail portions 524 to a printed circuit board using Surface Mounting Technology (SMT). However, such a problem can seriously affect the front end edge which is exposed to an outside of the phone without any protection. When the front end edge becomes eroded, the contact portion 523 of the contact 52 has an inferior electrical characteristic which adversely affects signal communication between the connector 5 and a mated connector (not shown).

Furthermore, referring specifically to FIG. 6, in the conventional connector 5, an electromagnetic protecting and grounding shield 53 is mounted to the housing 50 and has retentive tabs 531 downwardly extending toward the housing 50 to abut the front face 501 thereof thereby resisting a pull force acting on the housing 50 when a mating connector is withdrawn from the connector 5. However, such a design cannot effectively resist a push force during insertion of the mating connector into the connector 5, resulting in a large portion of the push force being exerted on the connection between the tail portions 524 of the contacts 52 and the printed circuit board. After a period of use of the connector, the push force may cause the tail portions 52 to separate from the printed circuit board thereby electrically disconnecting the connector 5 from the cellular phone.

Hence, an improved connector is needed to eliminate the above mentioned defects of the current connector.

SUMMARY OF THE INVENTION

Accordingly, an objective of the present invention is to provide a plug connector used in a cellular phone, which has a housing insert molded with contacts each having a bare front end edge protected from the affects of humidity and foreign particles by a portion of the housing covering the front end edge.

Another objective of the present invention is to provide a plug connector used in a cellular phone, which has a metallic shield enclosing a housing and contact portions of contacts thereof. The shield has retentive tabs extending therefrom for abutting front and rear faces of the housing thereby enabling the housing to resist pull and push forces due to the withdrawal/insertion of a mating connector from/into the connector.

To fulfill the above mentioned objectives, according to one embodiment of the present invention, a plug connector in a cellular phone for connecting the cellular phone with a battery charger consists a number of contacts and a dielectric housing insert molded therewith. The housing has a front face for engaging with a mated connector, a rear face, a bottom face for proximity to a printed circuit board, and a top face. A flat wall defining a number of contact passageways projects forward from the front face. Each contact has a contact portion received in the corresponding contact passageway and a bare front end edge downwardly extending at an incline into a front end of the flat wall for being protected from the affects of humidity and foreign particles.

A metallic shield is mounted to the housing and encloses it together with the contact portions of the contacts. The shield has a pair of front retentive tabs bent to abut the front face of the housing and rear retentive tabs bent to abut the rear face of the housing, whereby the connector can effectively resist pull and push forces acting on the housing during the insertion/withdrawal of a mated connector into/from the connector.

DETAILED DESCRIPTION OF THE PREFERRED EMBODIMENT

Reference will now be made in detail to the preferred embodiment of the present invention.

Figure 1:
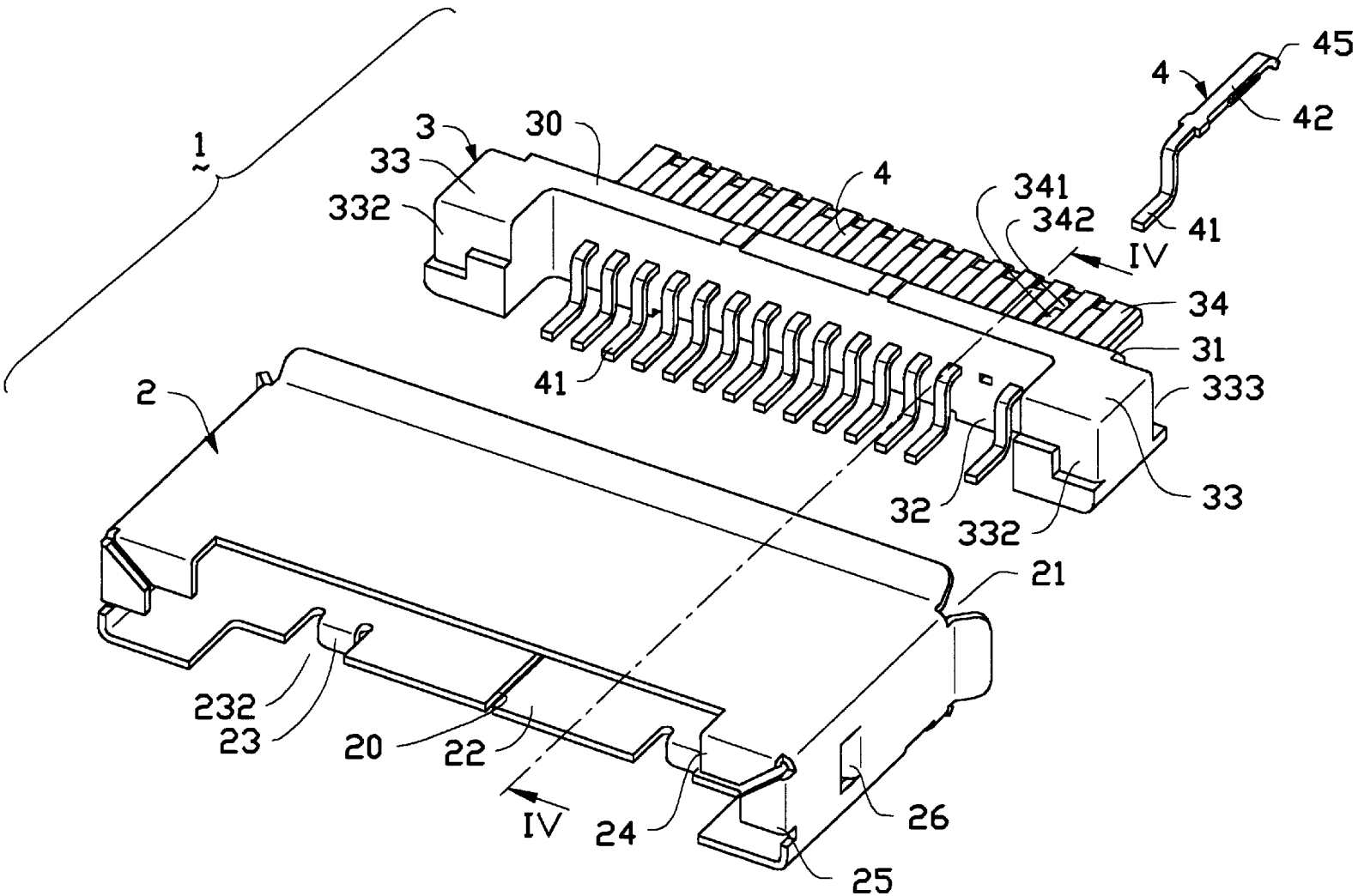
FIG. 1 is a perspective, exploded view of a plug connector in accordance with the present invention.
Figure 4:
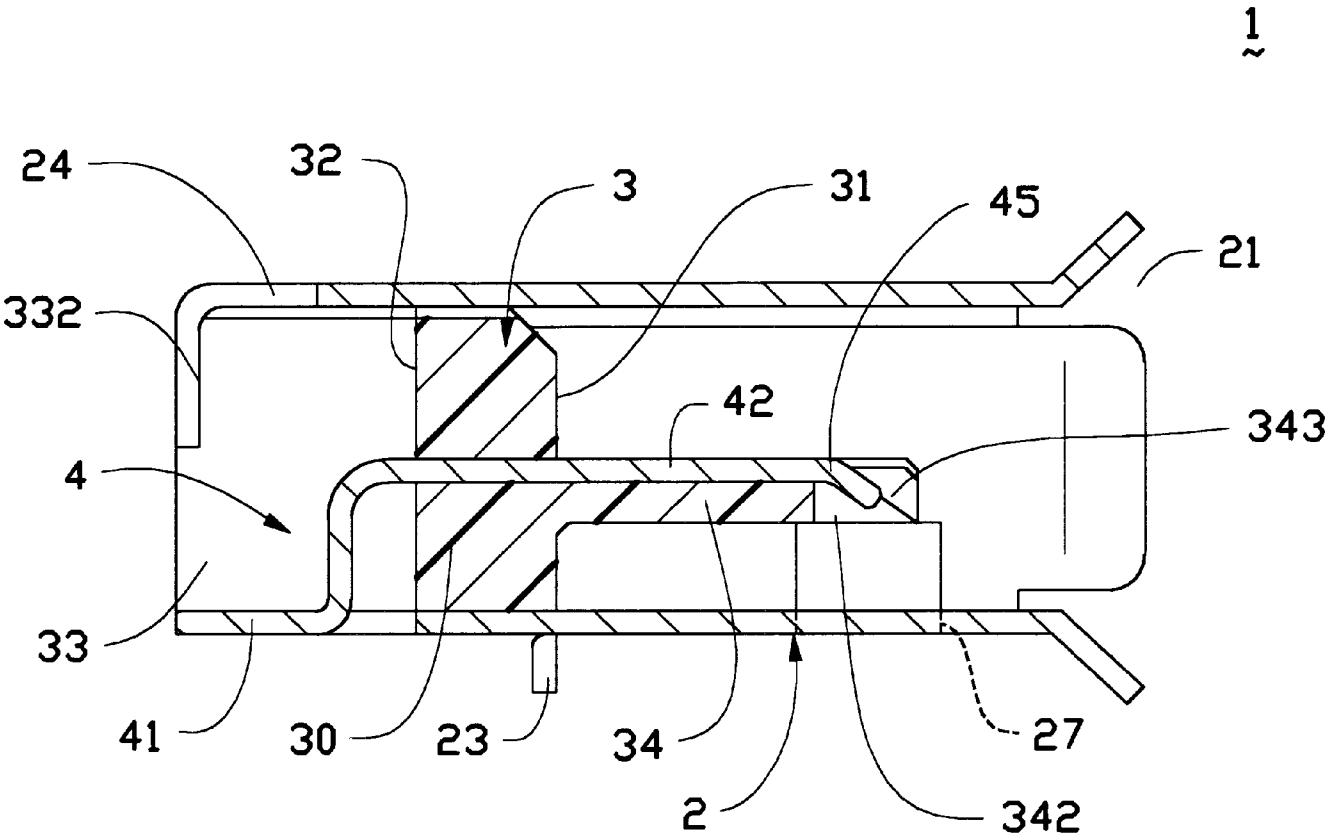
FIG. 4 is a cross-sectional view taken along line IV—IV of FIG. 1.
Figure 5:
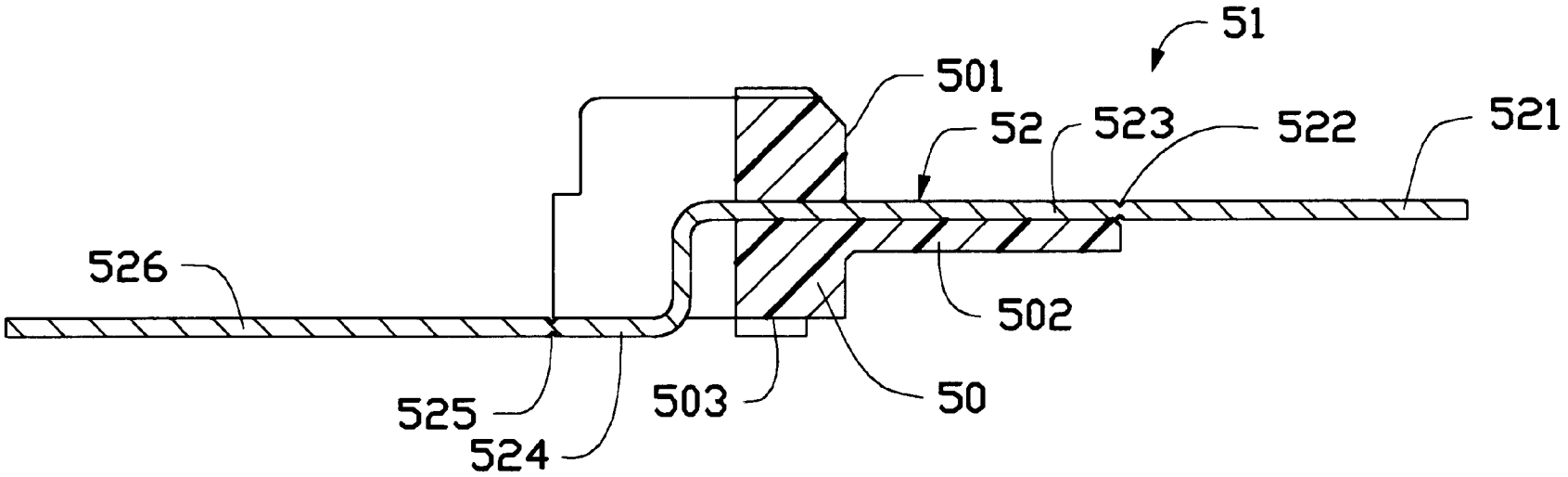
FIG.5 (PRIOR ART)
FIG. 5 is a cross-sectional view showing a housing insert molded with a blank contact for producing a conventional plug connector.
Figure 6:
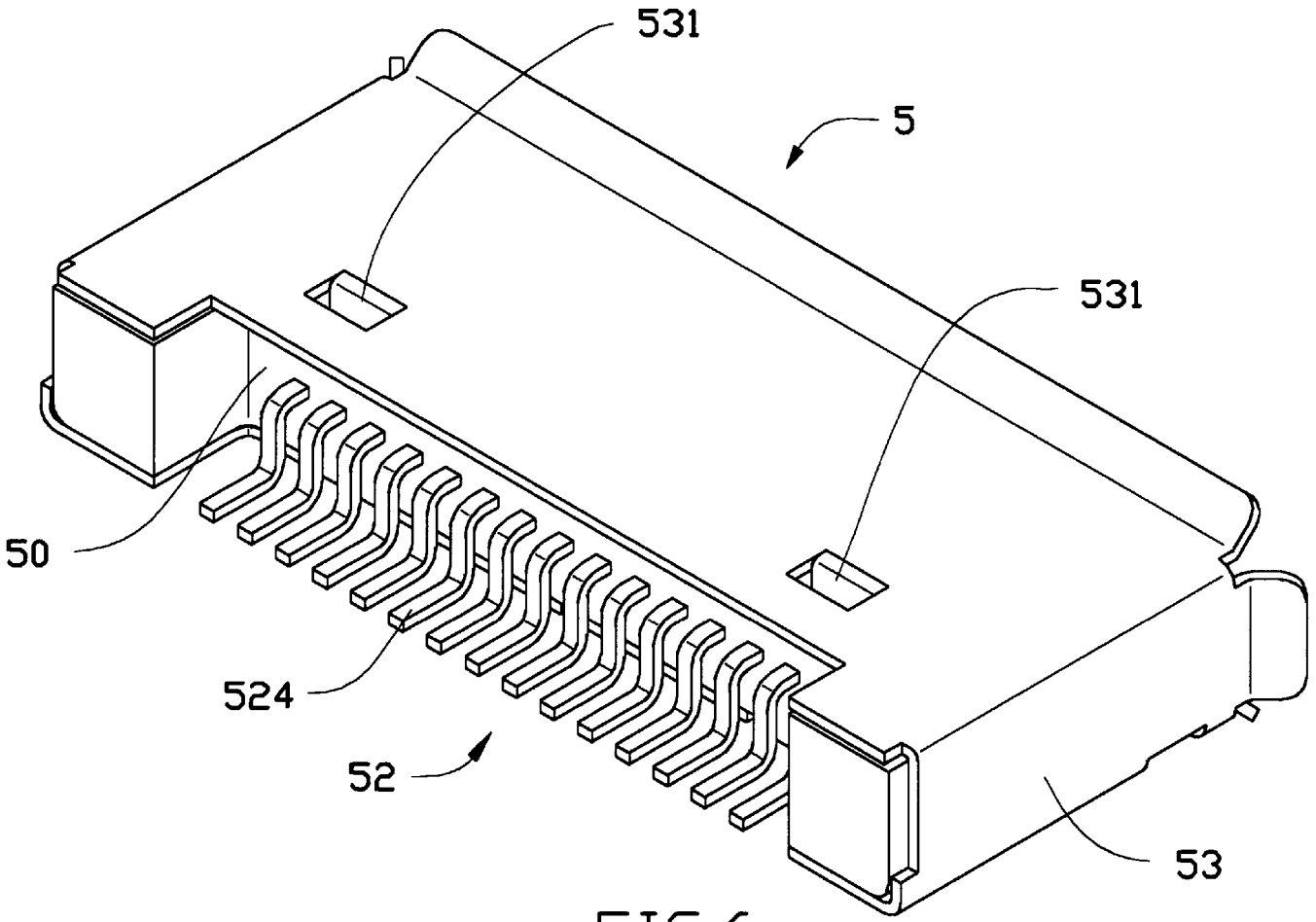
FIG.6 (PRIOR ART)
FIG. 6 is a perspective view of a conventional plug connector produced from the subassembly of FIG. 5.

Referring to FIGS. 1 and 4, a plug connector 1 for mounting in a cellular phone (not shown) and connecting to a battery charger (not shown) consists of a dielectric housing 3, a number of contacts 4 fixed to the housing 3 by insert molding, and an electromagnetic protecting and grounding shield 2 mounted to the housing 3 and enclosing contact portions 42 of the contacts 4. The contact portions 42 electrically engage with a mated connector (not shown).

Figure 2A:
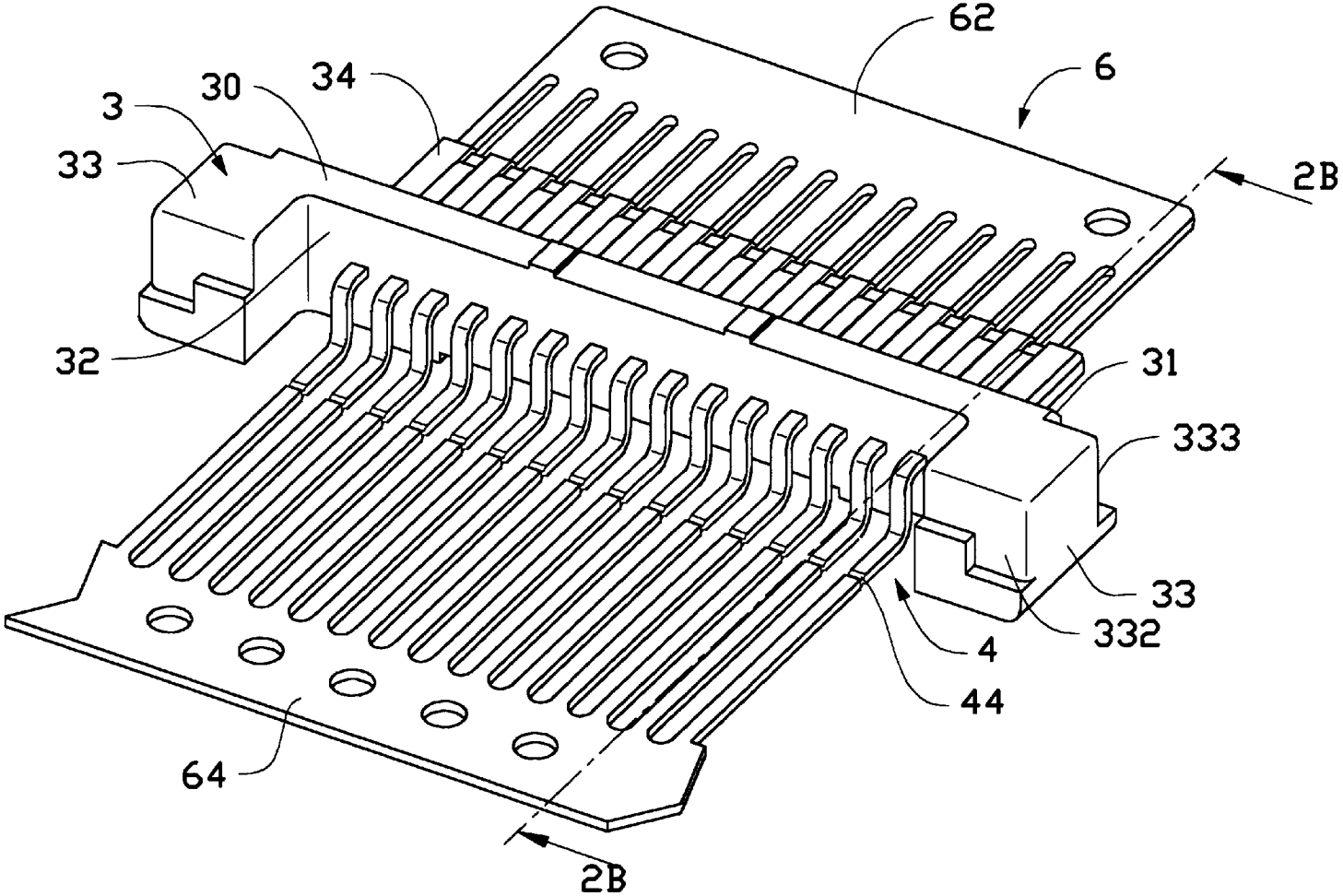
FIG. 2A is a perspective view showing a housing insert molded with a blank contact for forming the plug connector of FIG. 1.
Figure 2B:
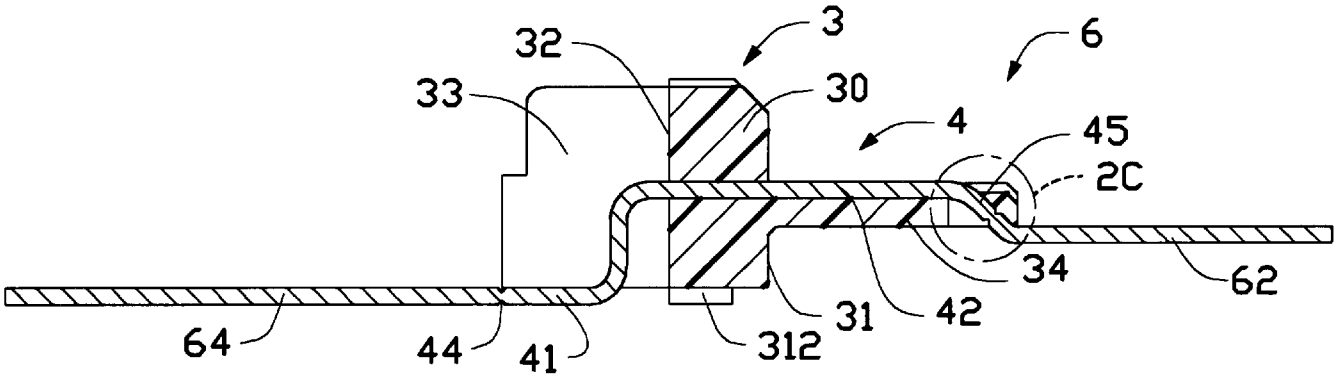
FIG. 2B is a cross-sectional view taken along line 2B—2B of FIG. 2A.
Figure 2C:
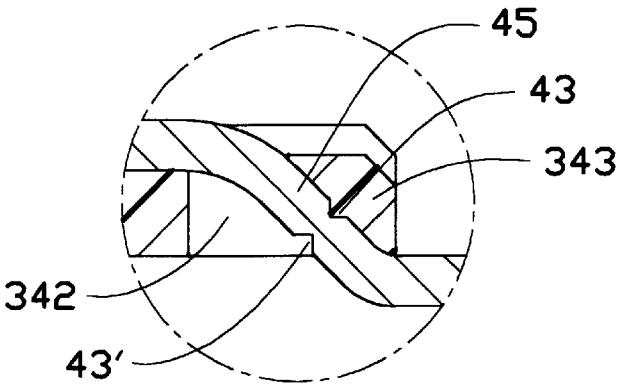
FIG. 2C is an enlarged view of a portion of FIG. 2B indicated by a circle 2C.

Referring to FIGS. 2A to 2C, to insert mold the housing 3 with the contacts 4, the contacts 4 are firstly formed by stamping a metal sheet to form a blank contact 6 having a front carrier 62 connecting with the contact portions 42 of the contacts 4 via a number connecting sections 45, and a rear carrier 64 connecting with tail portions 41 of the contacts 4 via rear V-cuts 44. Each connecting section 45 defines a front upper V-cut 43 on an upper face and a front lower V-cut 43' on a lower face thereof. The contact portions 42 of the contacts 4 are offset from the front carrier 62 via the corresponding connecting sections 45. The connecting sections 45 extend forward and downward from the corresponding contact portions 42 toward the front carrier 62.

The insert molding of the housing 3 with the contacts 4 further forms a wall 34 horizontally projecting from a front face 31 of a rectangular body 30 of the housing 3. A number of protective caps 343 are integrally formed on a front end of the wall 34. Each protective cap 343 covers the upper face of the corresponding connecting section 45 where the front upper V-cut 43 is defined. The wall 34 defines a number of contact passageways 341 (FIG. 1) fixedly receiving the contact portions 42 of the contacts 4 therein. A number of holes 342 are defined in the front end of the wall 34 below and behind the corresponding protective caps 343. The front lower V-cuts 43' are exposed in the corresponding holes 342.

The front and rear carriers 62, 64 are then bent away from the contacts 4 along the front V-cuts 43, 43' and the rear V-cuts 44 to form the structure as shown in FIG. 1. Since the front end edges (not labeled) of the contact portions 42 of the contacts 4 are covered by the protective caps 343, humidity and foreign particles will not easily affect the front end edges; thus, erosion thereof can be prevented.

Referring back to FIG. 1, the body 30 of the housing 3 further defines a rear face 32 from which the tail portions 41 of the contacts 4 extend rearward and downward for being soldered to a printed circuit board (not shown) on which the connector 1 is mounted. Two ears 33 are formed on two lateral sides of the body 30 behind the rear face 32 thereof. Each ear 33 defines a front rectangular depression 333 and a rear L-shaped depression 332. Referring to FIG. 2B, two positioning protrusions 312 (only one shown) are formed on a bottom of the body 30 of the housing 3.

The shield 2 is formed by stamping a metal sheet to have a rectangular tubular configuration with an internal space 22 for receiving the combination of the housing 3 and the contacts 4, a connecting slit 20 in a middle of a lower wall (not labeled) thereof, and a flared inlet 21 for facilitating insertion of a mated connector into the connector 1. Two front retentive tabs 26 (only one shown) are formed on two lateral walls (not labeled) of the shield 2. A first pair of rear retentive tabs 24 are formed to extend downward from a rear edge of two lateral sides of an upper wall (not labeled) of the shield 2. A second pair of rear retentive tabs 25 are formed to extend from rear edges of the lateral walls of the shield 2 toward a middle thereof. The second rear retentive tabs 25 are oriented to be perpendicular to the first rear retentive tabs 24.

Figure 3:
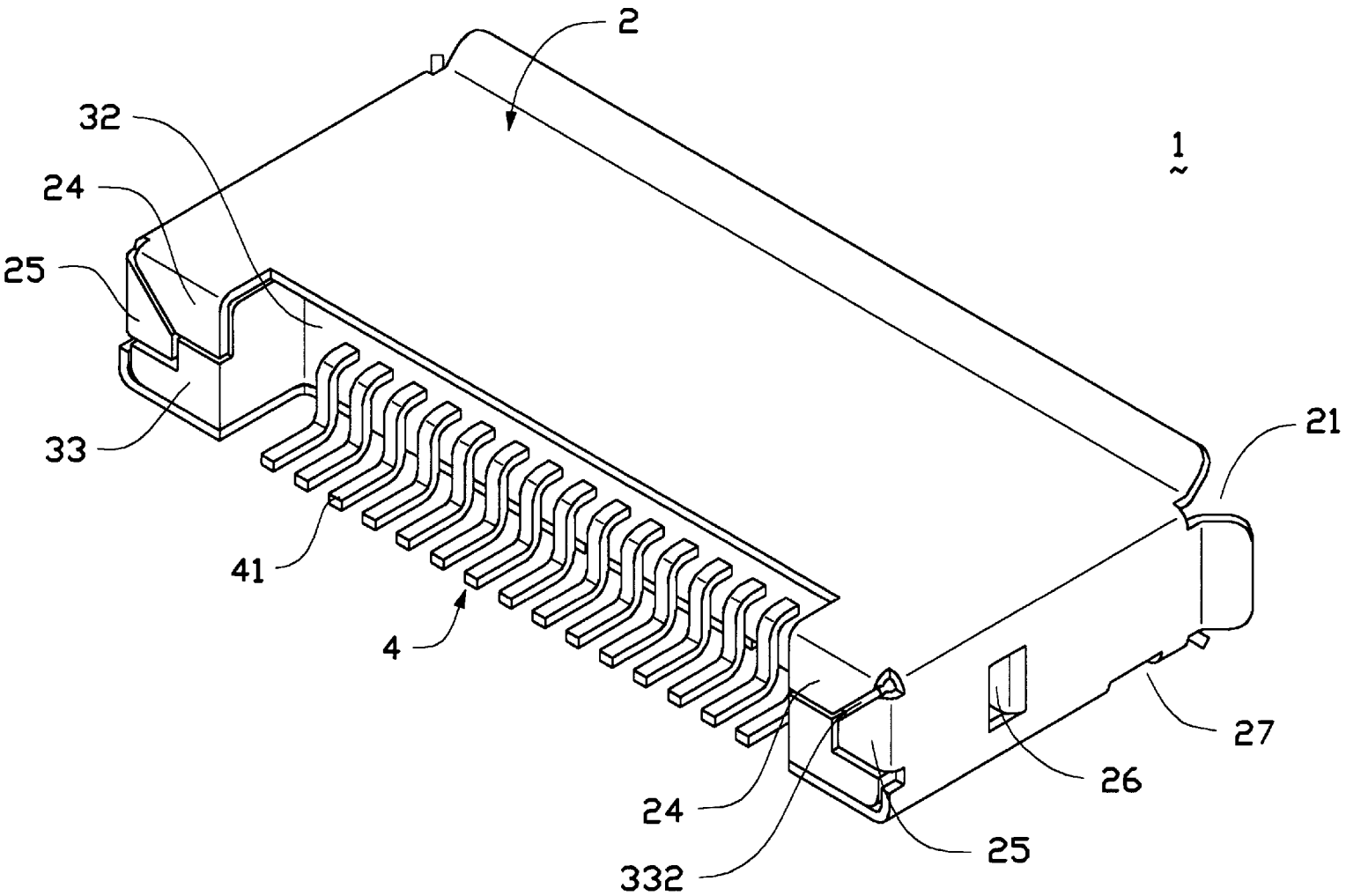
FIG. 3 is a perspective view of the assembled connector.

Also referring to FIGS. 3 and 4, two rectangular holes 27 (only one shown) are defined in two lateral sides of the lower wall of the shield 2 for extension of locking tabs of the mated connector therethrough when it is engaged with the connector 1. Two locating tabs 23 are formed to extend downward from a rear edge of the lower wall of the shield 2 beside the connecting slit 20. The locating tabs 23 are formed to facilitate positioning of the connector 1 on the printed circuit board so that the tail portions 41 of the contacts 4 can be correctly soldered thereto. The locating tabs 23 are also formed for fixing the shield 2 to the printed circuit board by soldering the locating tabs 23 thereto. A recess 232 is defined to the rear of each locating tab 23.

The shield 2 and the housing 3 are assembled together whereby the positioning protrusions 312 are fitted within the recesses 232, the front retentive tabs 26 extend into the rectangular depressions 333 to abut against front faces (not labeled) of the ears 33, and the rear tabs 24, 25 extend into the L-shaped depressions 332 to abut against rear faces of the ears 33. Thus, push and pull forces acting on the housing 3 can be effectively resisted by the shield 2, and the locating tabs 23 are soldered to the printed circuit board to prevent separation of the tail portions 41 of the contacts 4 from the printed circuit board.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical plug connector for use in a first electrical device to enable the first electrical device to connect with a second electrical device, comprising:

a number of conductive contacts; and a dielectric housing insert molded with the contacts;

said dielectric housing having a front face for contacting with a mated connector, a rear face, a bottom face for mounting on a printed circuit board in the first electrical device, a top face, and a contact receiving wall projecting forward from the front face;

each contact having a contact portion fixedly received on the contact receiving wall for electrically engaging with the mated connector and a tail portion rearwardly extending from the contact portion for being soldered to the printed circuit board, wherein each contact portion has a front distal end extending downwardly and forwardly at an acute angle into a corresponding hole defined in a front end of the contact receiving wall with an upper face of the front distal end being protected by a protective cap integrally formed with the wall and in front of the corresponding hole and a lower face of the front distal end being exposed to an exterior of the housing.

2. The connector in accordance with claim 1 further comprising a metallic shield mounted to the housing and enclosing the contact portions of the contacts.

3. The connector in accordance with claim 2, wherein the shield has a flared inlet for facilitating insertion of the mated connector into the connector.

4. The connector in accordance with claim 2, wherein the shield comprises a front retentive tab abutting the front face of the housing and a first rear retentive tab abutting the rear face of the housing so that pull or push forces acting on the housing by inserting/withdrawing a mated connector into/from the connector can be effectively resisted by the shield.

5. The connector in accordance with claim 4, wherein the shield has a rectangular tubular configuration with an upper wall close to the top face of the housing, a lower wall close to the bottom face of the housing and two lateral walls between the upper and lower walls, the shield having a front end for insertion of the mated connector into the connector and a rear end, the front retentive tab being formed at a middle portion of the shield and the first rear retentive tab being formed at the rear end of the shield.

6. The connector in accordance with claim 5, wherein the shield further comprises two locating tabs extending downward from the lower wall thereof for positioning the connector a printed circuit board and enabling the shield to be fixed to the printed circuit board by soldering the locating tabs thereto.

7. The connector in accordance with claim 5, wherein the shield has a flared front end for facilitating insertion of the mated connector into the connector.

8. The connector in accordance with claim 5, wherein the front retentive tab is formed by a middle portion of one of the lateral walls of the shield and the first rear retentive tab is formed by a rear edge of one of the lateral walls.

9. The connector in accordance with claim 8, wherein the shield further comprises a second rear retentive tab extending downward from a rear edge of the upper wall to abut the rear face of the housing.

10. The connector in accordance with claim 9, wherein the first and second rear retentive tabs extend perpendicularly to each other.

11. An electrical connector, comprising:

a number of contacts;

a housing insert molded with the contacts, said housing having a rectangular body with a front face for engaging with a mated connector, a rear face, a bottom face for mounting on to a printed circuit board, a top face, two ears integrally formed at two lateral sides of the body, and a contact receiving wall projecting forward from the front face between the ears, the wall fixedly receiving contact portions of the contacts, wherein each contact portion has a front distal end extending downwardly and forwardly at an acute angle into a front end of the wall to a position where an upper face of the front distal end of the contact portion is covered by the wall and a lower face thereof is exposed to an exterior of the housing; and a metallic shield mounted to the housing and enclosing the contact portions of the contacts, said shield having a front retentive tab abutting a front face of each of the ears and a rear retentive tab abutting a rear face of each of the ears.

12. The electrical connector in accordance with claim 11, wherein each ear defines a rectangular front depression and an L-shaped rear depression, and wherein the front retentive tab of the shield extends into the front depression and the rear retentive tab extends into the rear depression.

* * * * *